US005598143A

United States Patent [19]

Wentz

[11] Patent Number: 5,598,143

[45] Date of Patent: Jan. 28, 1997

[54] REMOTE CONTROL BEEPER LOCATOR

[76] Inventor: Jeff D. Wentz, 106 Cedar St., Lehighton, Pa. 18235

[21] Appl. No.: 589,789

[22] Filed: Jan. 22, 1996

Related U.S. Application Data

[63] Continuation of Ser. No. 165,178, Dec. 13, 1993, abandoned.

[51] Int. Cl.[6] ..... G08B 1/08

[52] U.S. Cl. ..... 340/539; 340/825.49; 340/572; 340/692; 340/825.72; 348/734

[58] Field of Search ..... 340/539, 825.69, 340/825.72, 825.49, 573, 572, 692; 348/734

[56] References Cited

U.S. PATENT DOCUMENTS 4,476,469 10/1984 Lander ..... 340/539

5,294,915 3/1994 Owen ..... 340/539

FOREIGN PATENT DOCUMENTS 62-72295 9/1987 Japan .

0314994 12/1988 Japan ..... 340/825.49

*Primary Examiner*—Donnie L. Crosland

[57] ABSTRACT

A system for changing the function of a television set through a fixedly positioned signal box and a hand held remote beeper and for locating a plurality of beepers if lost including a remote control signal box located at a television set for changing the functions of the television set; a plurality of hand held beepers operatively coupled to the signal box for allowing the functions of a television set to be remotely changed; an emitter in the signal box for sending out a corresponding electrical signal to each of the beepers; a receiver in each beeper for receiving such a corresponding electrical signal, whereupon beeping noises are produced for locating each beeper.

1 Claim, 4 Drawing Sheets

REMOTE CONTROL BEEPER LOCATOR

This application is a continuation of application Ser. No. 08/165,178 filed on Dec. 13, 1993, now abandoned.

FIELD OF THE INVENTION

The present invention relates to a remote control beeper locator and more particularly pertains to a system of a signal box and beeper with means on the box to locate the beeper if lost.

DESCRIPTION OF THE PRIOR ART

The use of electronic locators is known in the prior art. More specifically, electronic locators heretofore devised and utilized for the purpose of finding articles are known to consist basically of familiar, expected and obvious structural configurations, notwithstanding the myriad of designs encompassed by the crowded prior art which have been developed for the fulfillment of countless objectives and requirements.

Prior approaches to signaling of the type disclosed herein are described in U.S. Pat. No. 4,101,873 to Anderson and 4,507,653 to Bayer. Cox in U.S. Pat. No. 4,598,272 discloses the electronic monitoring of a person while Zeuschner in U.S. Pat. No. 3,855,575 discloses remote monitoring through ultrasonic signals. Lastly, U.S. Pat. No. 4,770,114 to Malone discloses bells, a flexible tail and colors to abate the prospects of losing a tv remote control box.

In this respect, the remote control beeper locator according to the present invention substantially departs from the conventional concepts and designs of the prior art, and in so doing provides an apparatus primarily developed for the purpose of locating a lost beeper.

Therefore, it can be appreciated that there exists a continuing need for new and improved remote control beeper locators which can find misplaced beepers and the like. In this regard, the present invention substantially fulfills this need.

SUMMARY OF THE INVENTION

In view of the foregoing disadvantages inherent in the known types of electronic locators now present in the prior art, the present invention provides an improved remote control beeper locator. As such, the general purpose of the present invention, which will be described subsequently in greater detail, is to provide a new and improved remote control beeper locator apparatus and method which has all the advantages of the prior art and none of the disadvantages.

To attain this, the present invention essentially comprises in combination a system for changing the function of a television set through a signal box and a hand held remote beeper and for locating the beeper if lost comprising, in combination a remote control signal box located at a television set, the signal box adapted to change the function of the television, such function including on/off channel changer, volume changer, and the like, the signal box having a receiver for receiving a signal from a remote source for changing such functions; a plurality of hand held receiver beepers operatively coupled to the signal box, each beeper having an emitter to emit a signal for being received by the receiver at the signal box to change the function of the TV and a battery within each beeper to power the emitter; an emitter in the signal box with an antenna adapted to send out an electrical signal in the citizen band range at any one of a plurality of discrete frequencies corresponding to the number of the number of the beepers, the plurality of switches in the signal box corresponding in number to the number of beepers and frequencies, each switch adapted to emit a signal of a different frequency, the function of the particular switch energized by a user; a receiver in each signal box with an antenna, each receiver adapted to receive an electrical signal in the citizen band range, each receiver being tuned to a particular frequency emitted by the signal box as dictated by the particular switch energized by a user; an audio component in each receiver to generate a noise upon the receipt by the beeper of a particular signal from the signal box of its correlated frequency, the audio component being powered by the battery.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved remote control beeper locator which has all the advantages of the prior art electronic locators and none of the disadvantages.

It is another object of the present invention to provide a new and improved remote control beeper locator which may be easily and efficiently manufactured and marketed.

It is a further object of the present invention to provide a new and improved remote control beeper locator which is of a durable and reliable construction.

An even further object of the present invention is to provide a new and improved remote control beeper locator which is susceptible of a low cost of manufacture with regard to both materials and labor, and which accordingly is then susceptible of low prices of sale to the consuming public, thereby making such remote control beeper locators economically available to the buying public.

Still yet another object of the present invention is to provide a new and improved remote control beeper locator which provides in the apparatuses and methods of the prior art some of the advantages thereof, while simultaneously overcoming some of the disadvantages normally associated therewith.

Still another object of the present invention is to cause a lost beeper to emit a noise when lost in order to find it.

Yet another object of the present invention is to relieve the frustration of losing lost remote controls.

Even still another object of the present invention is to provide a new and improved system for changing the function of a television set through a signal box and a hand held remote beeper and for locating the beeper if lost comprising, in combination a remote control signal box located at a television set, the signal box adapted to change the function of the television, such function including on/off channel changer, volume changer, and the like, the signal box having a receiver for receiving a signal from a remote source for changing such functions; a plurality of hand held receiver beepers operatively coupled to the signal box, each beeper having an emitter to emit a signal for being received by the receiver at the signal box to change the function of the TV and a battery within each beeper to power the emitter; an emitter in the signal box with an antenna adapted to send out an electrical signal in the citizen band range at any one of a plurality of discrete frequencies corresponding to the number of the number of the beepers, the plurality of switches in the signal box corresponding in number to the number of beepers and frequencies, each switch adapted to emit a signal of a different frequency, the function of the particular switch energized by a user; a receiver in each signal box with an antenna, each receiver adapted to receive an electrical signal in the citizen band range, each receiver being tuned to a particular frequency emitted by the signal box as dictated by the particular switch energized by a user; an audio component in each receiver to generate a noise upon the receipt by the beeper of a particular signal from the signal box of its correlated frequency, the audio component being powered by the battery.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
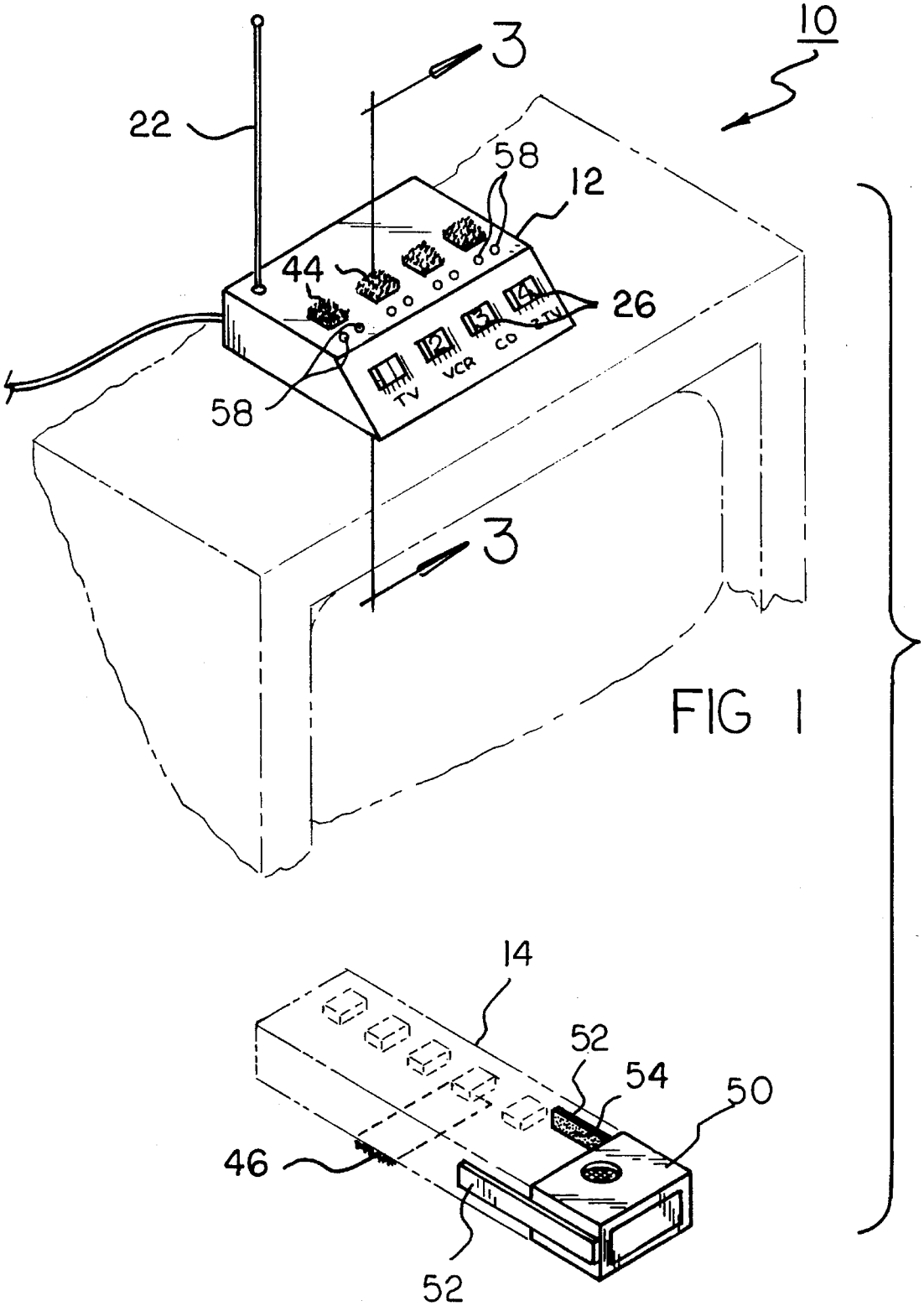
FIG. 1 is a perspective illustration of a tv with a fixedly positioned signal box and remote control beeper constructed in accordance with the principles of the present invention.
Figure 2:
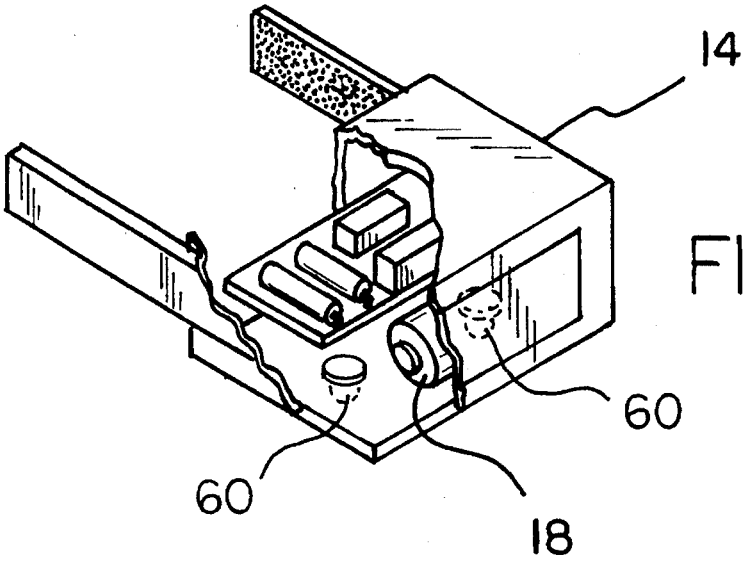
FIG. 2 is an enlarged perspective illustration of the signal components of the FIG. 2 beeper with parts broken away to show certain internal constructions thereof.
Figure 3:
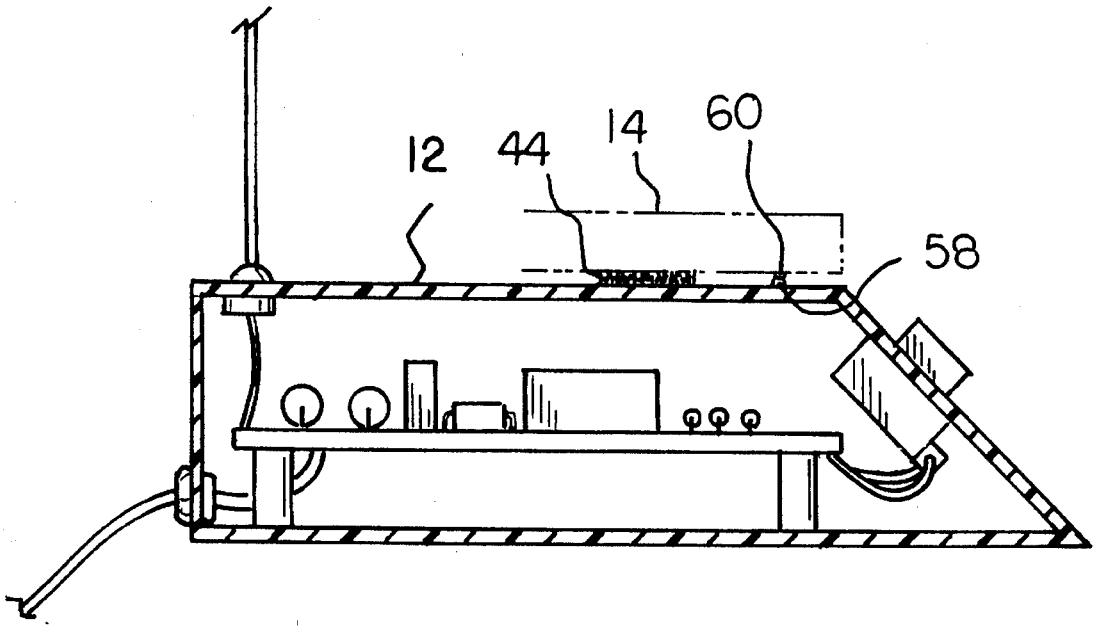
FIG. 3 is a sectional view of the signal box taken along line 3—3 of FIG. 1.
Figure 4:
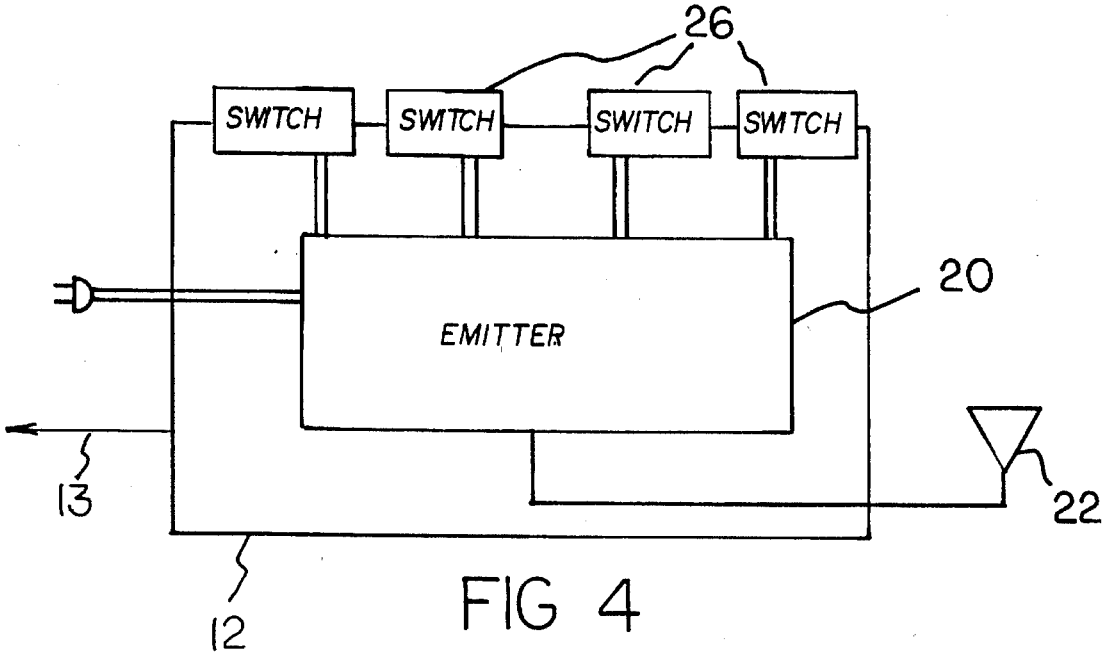
FIG. 4 is a schematic electrical diagram of the signal box.
Figure 5:
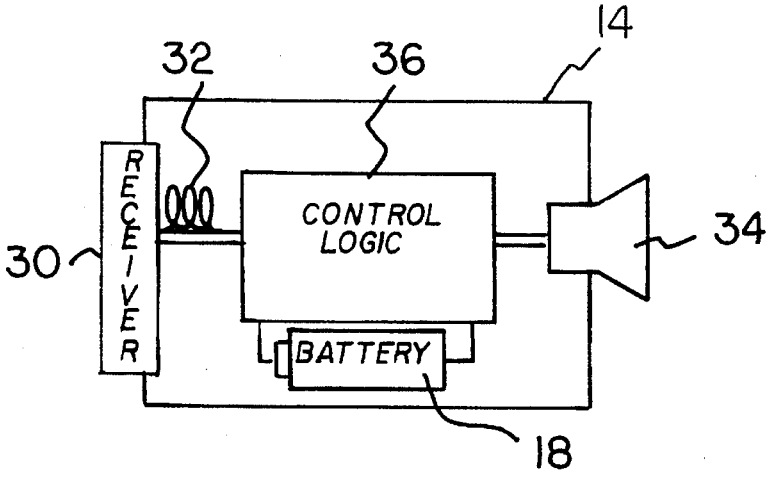
FIG. 5 is a schematic electrical diagram of the beeper.

With reference now to the drawings, and in particular to FIG. 1 thereof, a new and improved remote control beeper locator embodying the principles and concepts of the present invention and generally designated by the reference numeral 10 will be described.

More specifically, it will be noted that the system 10 of the present invention includes a signal box 12 fixedly positioned on a TV and a plurality of hand held remote control beepers 14.

The remote control signal box 12 is positioned on a television set. The signal box is adapted to change the function of the television set through interconnection 13. Such functioning includes on/off channel changer, volume changer, and the like all in a conventional manner. The signal box also has a receiver 14 for receiving a signal from a remote source for changing such functions, such function is also conventional. The signal box also gives off signals to receivers for locating them.

The second component of the system is a plurality of hand held, remotely positionable, beepers 14. The beepers are operatively coupled to the signal box 12. Each beeper has an emitter to emit a signal for being received by the signal box 12. Such signals function to change the function of the TV. A battery 18 is also provided within each beeper 14 for the powering thereof.

Also located within the signal box 12 is an emitter 20 with an antenna 22 adapted to emit an electrical signal in the citizen band range at any one of a plurality of discrete frequencies. The number of frequency is selected to correspond in number to the number of beepers. A plurality of switches 26 are also provided in the signal box 12 corresponding in number to the number of beepers and frequencies. Each switch 26 is adapted to generate and emit a signal of a different frequency. The particular switch being energized is selected by a user of the system. The switches are numbered and designated to send out a signal to a lost remote control beeper 14 as for a TV, VCR, CD, second TV or the like.

A receiver 30 and antenna 32 is provided in each beeper 14. Each receiver 30 is adapted to receive a discrete electrical signal in the citizen band range from the signal box 12. Each receiver is also tuned to a particular frequency emitted by the signal box as dictated by the particular switch energized by a user. An audio component 34 in each receiver to generate a noise, such noise is effected by appropriate control logic 36 energized through the receiver 30. Such noise will be created upon the receipt by the beeper 14 of a particular signal from the signal box of its associated tuned frequency. The audio component 34 is powered by the battery 18.

Figure 6:
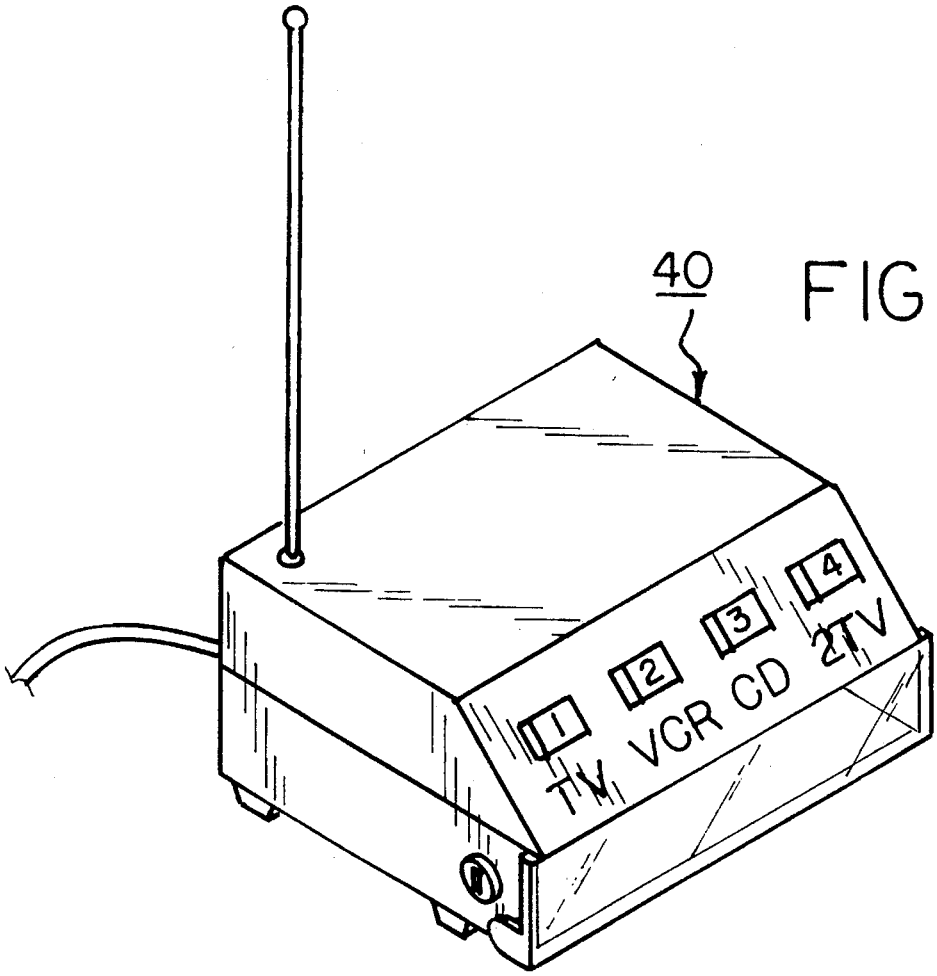
FIG. 6 is a perspective illustration of the signal box constructed in accordance with an alternate embodiment of the invention.
Figure 7:
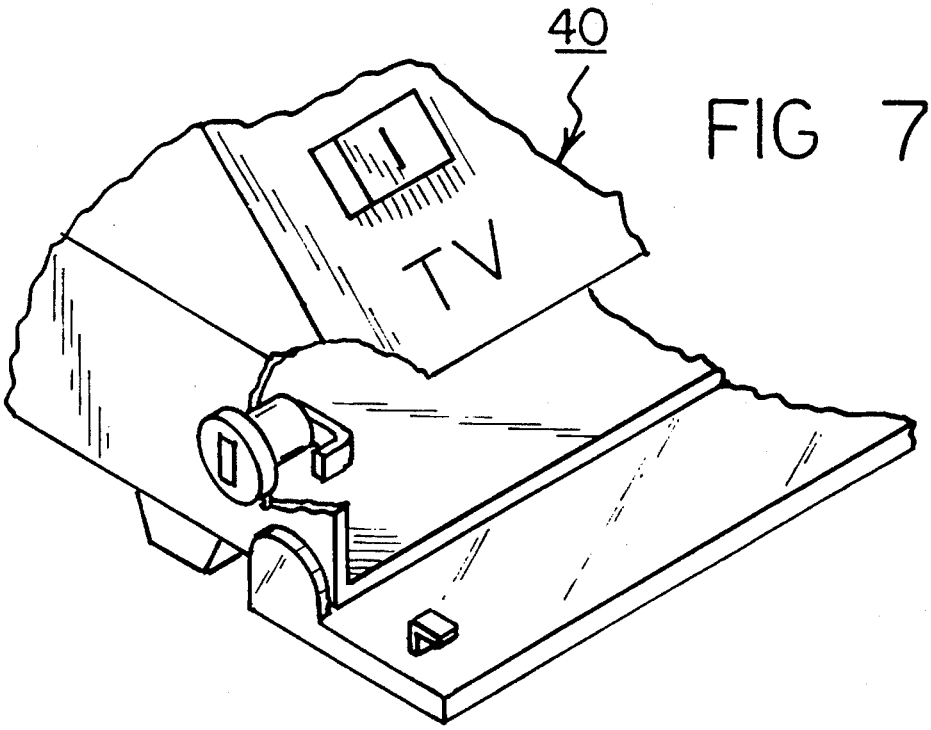
FIG. 7 is an enlarged perspective illustration of a portion of the signal box of FIG. 7.

In the primary embodiment of FIGS. 1 through 5, the signal box 12, with switches 26 and associated circuitry is formed integrally with a standard box used with cable television. In the embodiment of FIGS. 6 and 7, such switches 26 and circuitry is formed with a video cassette recorder box 40. Such switches 26 and circuitry could also be formed independent of a signal box or video cassette recorder. In this manner they could simply be attached by the user. They could, of course be built into the signal box by the manufacturer. One further aspect is that the switches 26 and associated circuitry could be a unit independent of the signal box or VCR box 40.

In any embodiment, the system may include attachment means for coupling a beeper or beepers 14 with the signal box. Preferably, the attachment means is a pile type fastener 44 and 46 on the signal box 12 and the beeper 14.

One additional aspect of the invention is the positioning of the electrical components of the beeper 14 into a compact module 50 positionable on the end of a standard beeper. Such module is formed with resilient parallel fingers 52 with facing frictional surfaces 54 adapted to contact and grasp the end of the beeper 14. One further aspect is that the switches 26 & associated circuitry could be a unit, independent of the signal box 2 or VCR box 40. It is understood, however, that the module and its components could be fabricated internal with the beeper by the manufacturer.

A final aspect for increasing the convenience and utility of the present system is utilizing a rechargeable battery in the remote control beeper 14. While the signal box could function from a battery, it is preferably powered by alternating current from a wall source. By having charging contacts 58 on the signal box 12 located to mate with contacts 60 of the remote control beepers 14 positioned on the signal box 12 when not in use, charging power is supplied continuously to the remote control beepers to extend the convenience and utility of the system.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A system for changing the function of a television set through a fixedly positioned remote control signal box and a hand held remote beeper and for locating the beeper if lost comprising:

a remote control signal box positionable in association with a television set and operatively connectable thereto, the control signal box being used to change functions of the television set with such functions including on/off, channel changer, and volume changer, the control signal box having a receiver for receiving a signal from a remote source for changing such functions;

a plurality of hand held, remotely positionable beepers operatively coupled to the control signal box, each beeper having an emitter to emit a signal, the beepers including a first beeper for emitting a signal that changes the function of the television set, a second beeper for emitting a signal that changes the function of a videocassette recorder, and a third beeper for emitting a signal that changes the function of a compact disc player, and a battery within each beeper for the powering thereof;

a plurality of compact beeper modules each having a pair of resilient parallel fingers with inwardly facing frictional surfaces adapted to contact and grasp the end of the each beeper;

an emitter in the control signal box with an antenna adapted to send out an electrical signal in a citizen band range at any one of a plurality of frequencies corresponding in number to the number of beepers, a plurality of switches in the control signal box corresponding in number to the number of beepers, the switches adapted to generate and emit a signal of a different frequency when actuated, the switches being energized selectively by a user;

a receiver and antenna each contained within the compact beeper module of the first beeper, the second beeper, and the third beeper, each receiver adapted to receive a discrete electrical signal, each receiver being tuned to a particular frequency emitted by the control signal box as dictated by the particular switch energized by a user; and an audio component in each receiver to generate a noise upon receipt by the beeper of a particular signal from the control signal box of its associated tuned frequency, the audio component being powered by a battery;

recharging contacts disposed within the control signal box and removably securable with the beeper for recharging its battery; and attachment means formed of a pile type fastener for removably coupling the beeper with the control signal box.

* * * * *